US007021908B2

(12) United States Patent
Mazuy

(10) Patent No.: US 7,021,908 B2
(45) Date of Patent: Apr. 4, 2006

(54) THERMAL PROTECTION SHIELD FOR A ROTATING SHAFT

(75) Inventor: Louis Mazuy, Maubeuge (FR)

(73) Assignee: Jeumont S.A., Courbevoie (FR)

( * ) Notice: Subject to any disclaimer, the term of this patent is extended or adjusted under 35 U.S.C. 154(b) by 129 days.

(21) Appl. No.: 10/300,768

(22) Filed: Nov. 21, 2002

(65) Prior Publication Data

US 2003/0136553 A1 Jul. 24, 2003

(30) Foreign Application Priority Data

Nov. 21, 2001 (FR) ..... 01 15076

(51) Int. Cl.
*F04B 17/00* (2006.01)

(52) U.S. Cl. ..... 417/373; 415/177

(58) Field of Classification Search ..... 464/170, 464/179, 183, 902; 417/373; 415/177; 277/412, 277/415; 228/59; 165/146
See application file for complete search history.

(56) References Cited

U.S. PATENT DOCUMENTS 3,194,083 A * 7/1965 Ballard ..... 464/183 X
3,421,445 A * 1/1969 Ivanoff ..... 415/177
4,127,080 A * 11/1978 Lakiza et al. ..... 464/183 X
4,820,119 A * 4/1989 Joyce ..... 277/415 X
4,932,836 A 6/1990 Boster
5,072,608 A 12/1991 Lorett
5,332,358 A * 7/1994 Hemmelgarn et al. .. 415/177 X
6,328,541 B1 * 12/2001 Veronesi et al. ..... 417/373
6,358,000 B1 * 3/2002 Veronesi et al.

FOREIGN PATENT DOCUMENTS

EP 0844399 A1 5/1998
FR 2812117 1/2002
WO WO 01/94069 A2 12/2001

OTHER PUBLICATIONS

France Search Report, FA 613047, FR 0115076, Aug. 2, 2002, pp. 1-2.

* cited by examiner

*Primary Examiner*—Greg Binda
(74) *Attorney, Agent, or Firm*—Connolly Bove Lodge & Hutz LLP

(57) ABSTRACT

A thermal protection shield for a rotating shaft of a primary coolant pump shaft of a nuclear power station includes, in the thermal transition region between the hot fluid and the cold fluid, a ring of nickel alloy shrunk onto the shaft. An external ring of austenitic stainless steel is shrunk at each of its ends onto the ring of nickel alloy. Between the two shrunk-on ends, a cylindrical cavity forms a clearance with the external surface of the nickel alloy ring.

6 Claims, 4 Drawing Sheets

THERMAL PROTECTION SHIELD FOR A ROTATING SHAFT

FIELD OF THE INVENTION

The present invention relates to a thermal protection shield for a rotating shaft, especially for a primary coolant pump shaft of a nuclear power station.

BACKGROUND OF THE INVENTION

Many industrial plants have rotating shafts which are subjected to temperature differences between two regions, causing large thermal stress variations on these shafts.

This is especially the case for the primary coolant pumps of a nuclear power station which convey hot water at high temperature.

In their top part, these primary coolant pumps include a heat exchanger, called a thermal barrier, which cools the water feeding a hydrodynamic bearing and the rotary seals with the longitudinal shaft. There is therefore a transition region between the hot water and the cold water located at the bottom of the thermal barrier.

That part of the shaft located in this transition region is consequently subjected to a large thermal gradient which promotes thermal instabilities that may create cracks in the shaft.

To reduce this risk of cracking, a thermal protection shield is placed over the shaft in the region where the thermal gradient is greatest.

Hitherto, this thermal protection shield was formed by a ring of stainless steel surrounding the shaft in said transition region. This solution does not suffice for completely safeguarding against the risk of cracking, since after a few years of operation cracks may appear at various places in the shaft below this ring.

SUMMARY OF THE INVENTION

The object of the invention is to provide a thermal protection shield which helps to improve the effectiveness of the protection and consequently to reduce the risks of cracking in the shaft.

The subject of the invention is therefore a thermal protection shield for a rotating shaft (1), especially for a primary coolant pump shaft of a nuclear power station, characterized in that it comprises, in the thermal transition region between the hot fluid and the cold fluid, a ring of nickel alloy shrunk onto said shaft.

According to other features of the invention:

- the ring of nickel alloy is surrounded by an external ring of austenitic stainless steel shrunk at each of its ends onto this ring of nickel alloy and comprising, between the two shrunk-on ends, a cylindrical cavity for forming a clearance with the external surface of said ring of nickel alloy;
- the wall of the cylindrical cavity of the external ring has projecting annular portions for reducing the clearance between said wall and the external face of the ring of nickel alloy;
- the total length of the shrunk-on ends of the external ring represents about 20% of the length of this ring;
- the shield includes a transverse pin of nickel alloy for linking the ring of nickel alloy with the shaft, said pin being mounted in an orifice made in the shaft and the ring, and the free end of this pin being welded to this ring;

- the shield includes a transverse pin of austenitic stainless steel for linking the ring of nickel alloy and the external ring of austenitic stainless steel with the shaft, said pin being mounted in an orifice provided in the shaft and the rings, and the free end of this pin being welded to the external ring;
- the shaft has, in the lower part of the ring of nickel alloy, a cavity in which a split ring is mounted;
- the split ring is made of a material whose expansion coefficient is identical to the material of the shaft.

BRIEF DESCRIPTION OF THE FIGURES

The features and advantages of the invention will become apparent in the course of the description which follows, given by way of example and with reference to the appended figures in which.

DETAILED DESCRIPTION OF THE INVENTION

Figure 1:
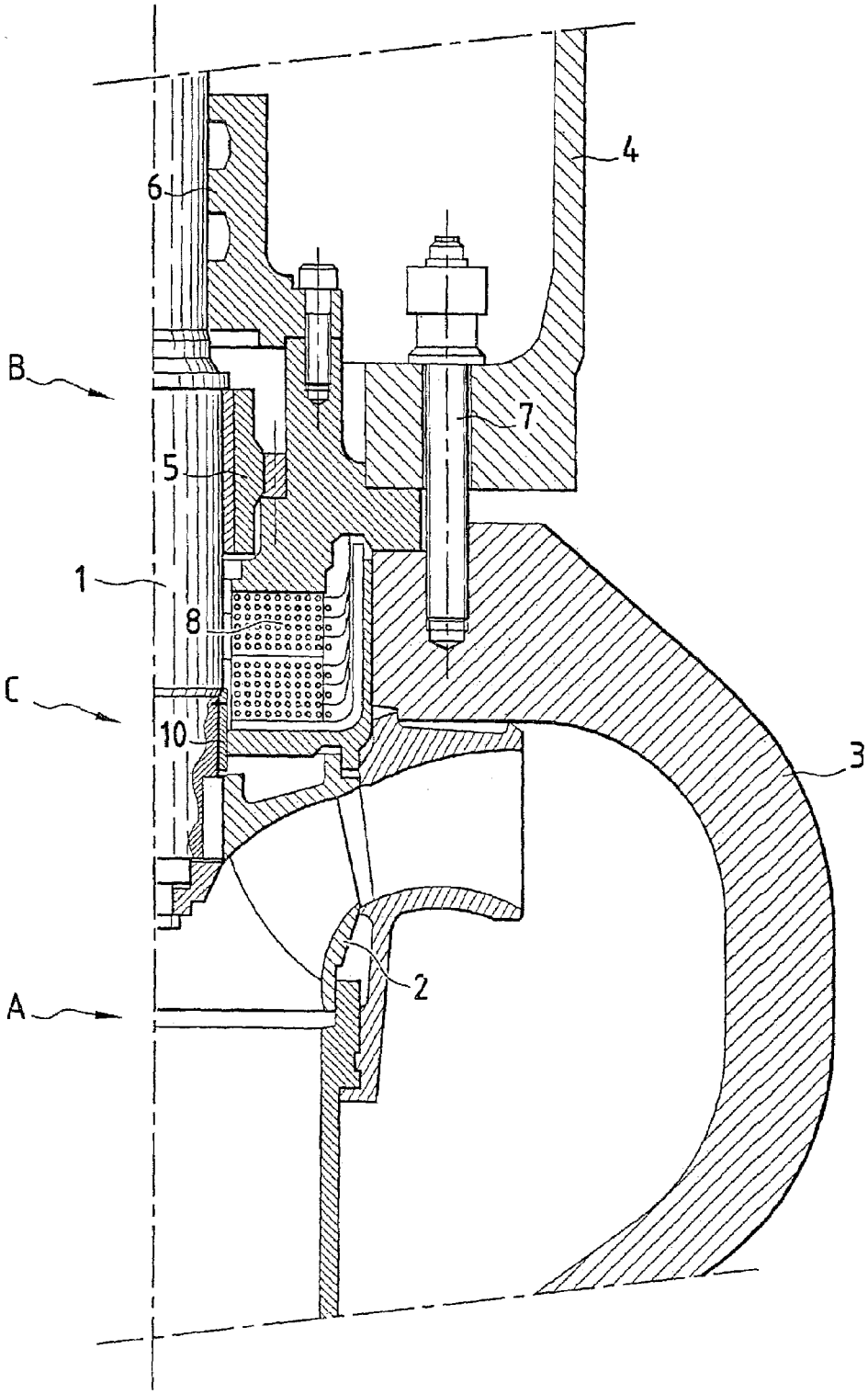
FIG. 1 is a schematic half-view in axial section of part of a primary coolant pump equipped with a thermal protection shield according to the invention.

Conventionally, this pump has a lower part A, called the hot part, in which the hot water circulates at a temperature of about 300° C. and an upper part B, called the cold part, in which the cold water circulates at about 40° C.

The regions A and B are penetrated by a shaft 1 and the lower part has, in a conventional manner, an impeller 2 and a pump volute 3.

The upper part B comprises a casing 4, a hydrodynamic bearing 5 and rotary seals 6.

The casing 4 is fastened to the volute 3 by means of removable linking elements 7, such as for example studs.

Between the lower part A and the upper part B, the pump has a heat exchanger 8, called a thermal barrier, which cools the water feeding the hydrodynamic bearing 5 and the rotary seals 6.

Between the lower part A, called the hot part, and the upper part B, called the cold part, there is a transition region C between the hot water and the cold water at the bottom of the heat exchanger 8 and in which the shaft region is subjected to a large thermal gradient of about 260° C.

In this transition region C, the shaft 1 is equipped with a thermal protection shield denoted in its entirety by the reference 10.

Figure 2:
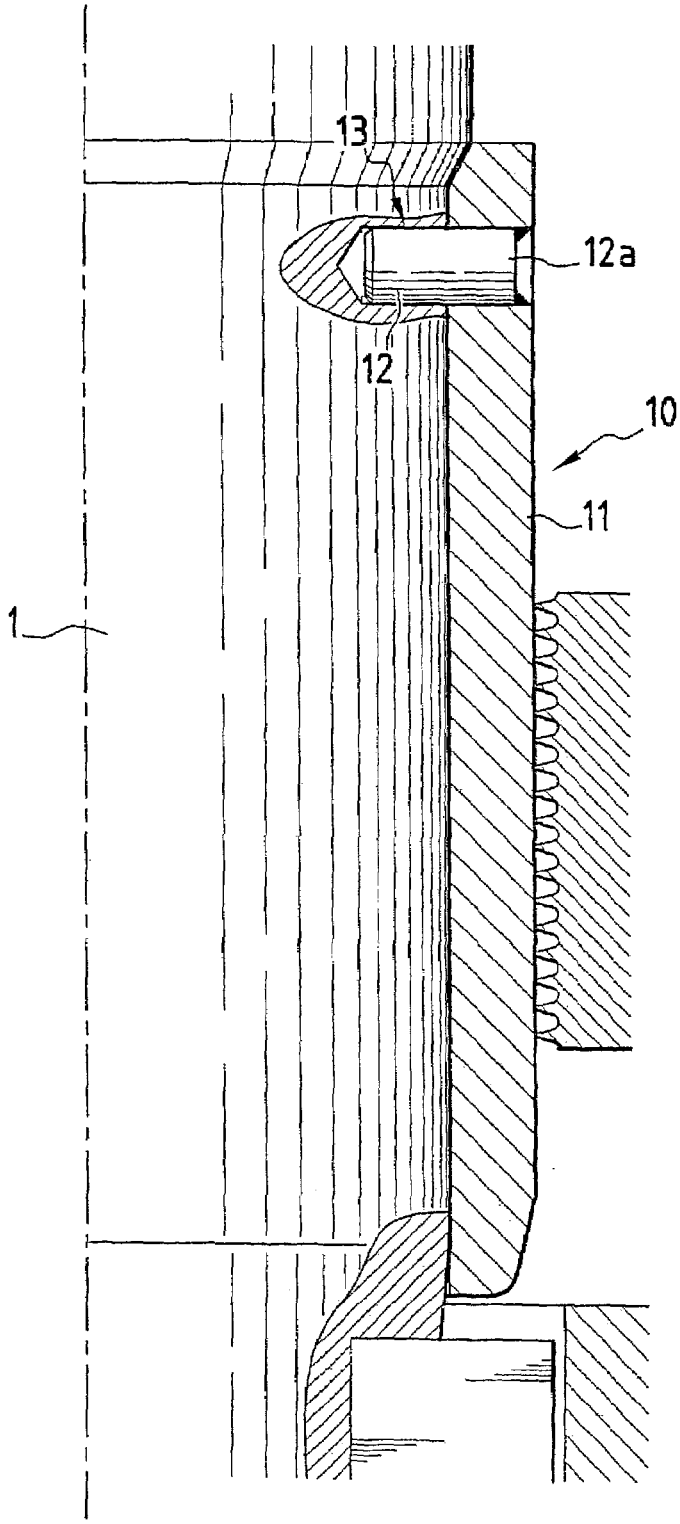
FIG. 2 is a schematic view in axial section and on a larger scale of a first embodiment of the thermal protection shield according to the invention.

According to a first embodiment shown in FIG. 2, the thermal protection shield 10 comprises, in the thermal transition region C between the hot fluid and the cold fluid, a ring 11 made to nickel alloy shrunk over its entire length onto said shaft 1.

The nickel alloy of which the ring 11 is made is chosen so that the metal/metal contact between the shaft 1, which is made of austenitic stainless steel, and this ring 11 of nickel alloy is maintained in standard operating situations.

The characteristics of the nickel alloy ensure that this contact is possible by virtue of its expansion coefficient being lower than that of the metal of which the shaft 1 is made and also by its ability to withstand the thermal transients without becoming plasticized.

One of the most effective alloys for this function is, for example, "Inconel 718".

The protection shield 10 includes a transverse pin 12 of nickel alloy, linking the ring 11 with the shaft 1. This pin 12 is mounted in an orifice 13 made in the shaft 1 and in the ring 11, and the free end 12*a* of this pin 12 is welded to this ring 11.

Figure 3:
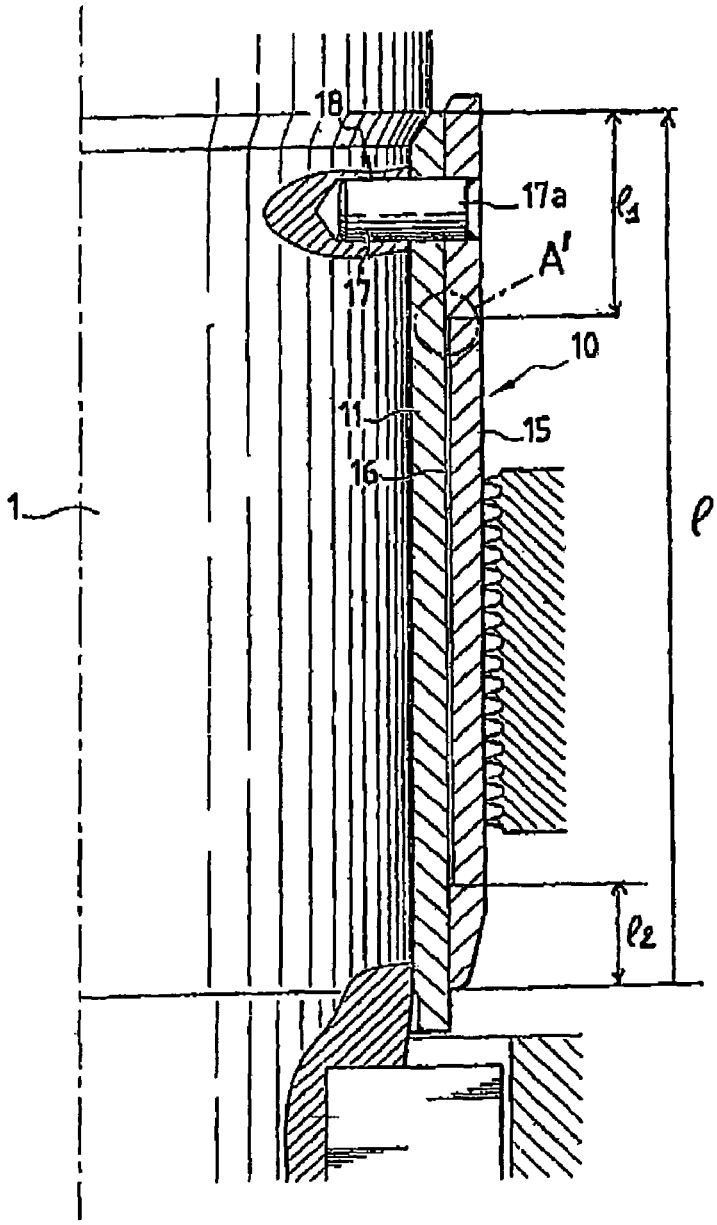
FIG. 3 is a schematic view in axial section and on a larger scale of a second embodiment of the thermal protection shield according to the invention.

According to a second embodiment shown in FIG. 3, the ring 11 of nickel alloy is surrounded by an external ring 15 of austenitic stainless steel.

This external ring 15 is shrunk at each of its end sections onto the ring 11 of nickel alloy and has, between the two shrunk-on end section, a cylindrical cavity 16 for forming a clearance with the external surface of said ring 11.

Thus, the external ring 15 protects the ring 11 of nickel alloy from instabilities in the transition region between the hot water and the cold water.

The clearance formed by the cavity 16 is fixed in such a way that the external ring 15 deformed by the thermal gradient in the nominal operating situation comes into contact with the external surface of the ring 11 of nickel alloy.

This deformation makes it possible to eliminate or minimize the film of water that can circulate between the two rings 11 and 15, since the circulation of water between said rings promotes thermal fatigue.

The thermal insulation is also improved by the presence of the ring 11 of nickel alloy, which has a low conductivity.

Preferably, the total length of the end sections $l_1$ and $l_2$ of the external ring 15 that are shrunk onto the ring 11 of nickel alloy represents about 20% of the length l of this external ring 15 so that $l_1+l_2=20\%\ l$.

In this embodiment too, the protection shield 10 has a transverse pin 17 of austenitic stainless steel for linking the rings 11 and 15 with the shaft 1. This pin 17 is mounted in an orifice 18 made in the shaft 1 and the rings 11 and 15, and the free end 17*a* of this pin 17 is welded to the external ring 15.

Figure 4:
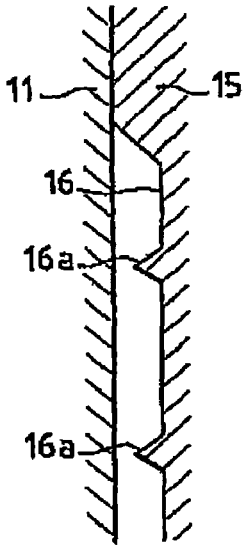
FIG. 4 is a view on a larger scale of detail A' in FIG. 3.

According to a variant shown in FIG. 4, the wall of the cylindrical cavity 16 of the external ring 15 includes projecting annular portions 16*a* for reducing the clearance between the wall of the cavity and the external face of the ring 11 of nickel alloy.

Preferably, the projecting portions 16*a* are distributed in an equidistant manner.

During a maintenance operation relating to the monitoring of the surface state of the shaft 1 in the critical region, the ring 11 of nickel alloy is systematically removed. If the region of the shaft to be protected by the thermal protection shield has shallow cracks, these cracks may be eliminated in the following manner.

After removing the ring 11 of nickel alloy and possibly the external ring 15, the shaft 1 is locally recessed in order to eliminate the cracks.

Figure 5:
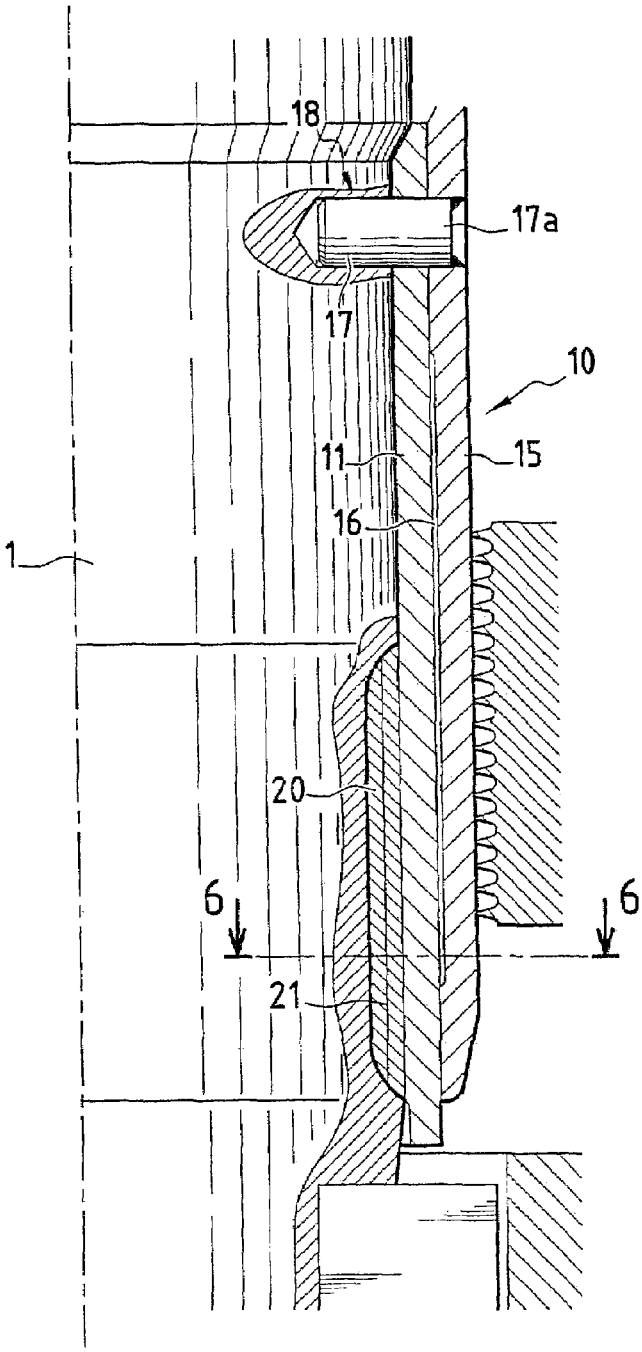
FIG. 5 is a schematic view in axial section and on a larger scale of a third embodiment of the thermal protection shield according to the invention.
Figure 6:
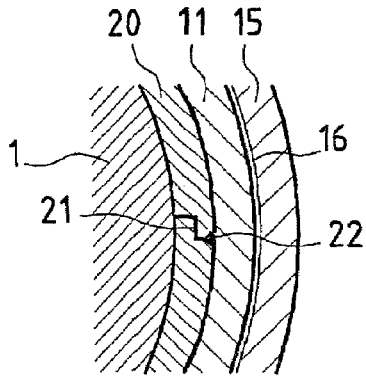
FIG. 6 is a partial section view on the line 6—6 in FIG. 5, according to the first embodiment.
Figure 7:
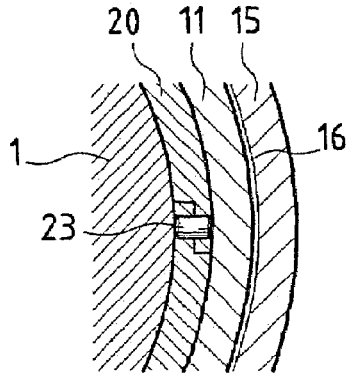
FIG. 7 is a partial section view that is a modification of FIG. 6, according to a second embodiment.

As shown in FIG. 5, a split ring 20 is placed on the shaft 1 in the recess thus formed, and the adjacent edges of the split 21 of this ring 20 are fastened together by a weld bead 22 (FIG. 6) or by at least one radial pin 23 (FIG. 7) or by adhesive bonding or by means of winding a wire. This winding is placed in a groove (not shown) made in the ring 20, preferably in the top part of this ring 20. The width of this groove is determined so as to house a minimum of two turns of wire, the latter being welded at its two ends in the bottom of the groove.

The ring 11 or the rings 11 and 15, depending on the embodiment, are then again mounted on the shaft 1.

Preferably, the split ring 20 is made of a material whose expansion coefficient is identical to the material of the shaft 1.

The shrinking-on of the ring 11 of nickel alloy and the fitting of the split ring 20 prevent the presence of moving water and therefore ensure effective thermal protection.

The thermal protection shield according to the invention provides more effective thermal protection of the shaft by virtue especially of the presence of the ring of nickel alloy, while still taking up the same amount of space as in the solutions used hitherto.

Under these conditions, the thermal gradients in the shaft are moderated in a more gradual manner, with the result that the risks of the shaft cracking, especially in the case of a primary coolant pump shaft, are consequently reduced.

What is claimed is:

1. A thermal protection shield for a rotating shaft of a primary coolant pump shaft of a nuclear power station, wherein the shield comprises, in the thermal transition region between the hot fluid and the cold fluid:

a ring of nickel alloy shrunk onto said shaft;

an external ring of austenitic stainless steel surrounding the nickel alloy ring, the external ring shrunk at each of its ends onto the ring of nickel alloy; and a cylindrical cavity between the two shrunk on ends for forming a clearance with the external surface of said ring of nickel alloy.

2. A shield according to claim 1, wherein a wall of the cylindrical cavity of the external ring has projecting annular portions for reducing the clearance between said wall and the external face of the ring of nickel alloy.

3. A shield according to claim 1, wherein the total length of the shrunk-on ends of the external ring represents about 20% of an overall length of the external ring.

4. A shield according to claim 1, further comprising:

a transverse pin of austenitic stainless steel for linking the ring of nickel alloy and the external ring of austenitic stainless steel with the shaft;

the pin being mounted in an orifice provided in the shaft and both rings; and the free end of the pin being welded to the external ring.

5. A shield according to claim 1, wherein the shaft has, in the lower part of the ring of nickel alloy, a cavity in which a split ring is mounted.

6. A shield according to claim 5, wherein the split ring is made of a material whose expansion coefficient is identical to the material of the shaft.

* * * * *